US005946879A

United States Patent [19]

Pellock

[11] Patent Number: 5,946,879

[45] Date of Patent: Sep. 7, 1999

[54] IN-PLANE BRACE FOR WEB MEMBERS IN TRUSSES AND TRUSS WITH BRACED WEB MEMBERS

[75] Inventor: Michael A. Pellock, Edwardsville, Ill.

[73] Assignee: Mitek Holdings, Inc., Wilmington, Del.

[21] Appl. No.: 08/842,256

[22] Filed: Apr. 24, 1997

[51] Int. Cl.[6] ..... E04C 3/02

[52] U.S. Cl. ..... 52/690; 52/92.1; 52/636; 52/731.7; 52/730.7; 52/691; 403/232.1

[58] Field of Search ..... 52/690, 691–696, 52/698, 699, 702, 703, 712, 713, 634, 636, 650.1, 92.1–92.3, 97.1, 737.2, 733.7, 731.7, DIG. 6, 737.3; 403/232.1, 403

[56] References Cited

U.S. PATENT DOCUMENTS

| | | | |
|---|---|---|---|
| D. 266,328 | 9/1982 | Fleshman | 248/300 X |
| 2,941,484 | 6/1960 | Marsh | 52/642 |
| 4,294,051 | 10/1981 | Hughes, Jr. | 52/92.2 X |
| 4,649,688 | 3/1987 | Mosier | 52/693 X |
| 4,866,798 | 9/1989 | Harris | 52/730.1 X |
| 5,058,352 | 10/1991 | Loiselle et al. | 52/696 X |
| 5,148,890 | 9/1992 | Sipe | 52/749.1 X |
| 5,377,472 | 1/1995 | Terenzoni | 52/730.7 |
| 5,551,200 | 9/1996 | Krug | 52/690 X |
| 5,609,007 | 3/1997 | Eichner | 52/506.07 X |
| 5,735,035 | 4/1998 | Holt | 52/97 X |
| 5,775,048 | 7/1998 | Orchard | 52/712 |

FOREIGN PATENT DOCUMENTS

| | | | |
|---|---|---|---|
| 1009559 | 11/1965 | United Kingdom | 52/690 |
| 2121848 | 4/1984 | United Kingdom . | |

*Primary Examiner*—Carl D. Friedman
*Assistant Examiner*—Winnie S. Yip
*Attorney, Agent, or Firm*—Armstrong Teasdale LLP

[57] ABSTRACT

A brace for mounting on a web member in a generally planar truss to resist flexing of the web member out of the plane of the wooden truss. The brace is an elongate metal member comprising a flange adapted to overlie a face of the web member, and a body, extending from the flange, adapted to lie substantially within the thickness of the web member. A plurality of teeth may be integrally formed in the flange to embed in the web member and mount the brace thereto. Alternatively, holes may be provided on the flange for mounting the brace. The brace, when mounted on a web member, helps reduce bending and flexing of the web member, out of the plane of the truss, and trusses that include the brace do not need cross-bracing.

30 Claims, 2 Drawing Sheets

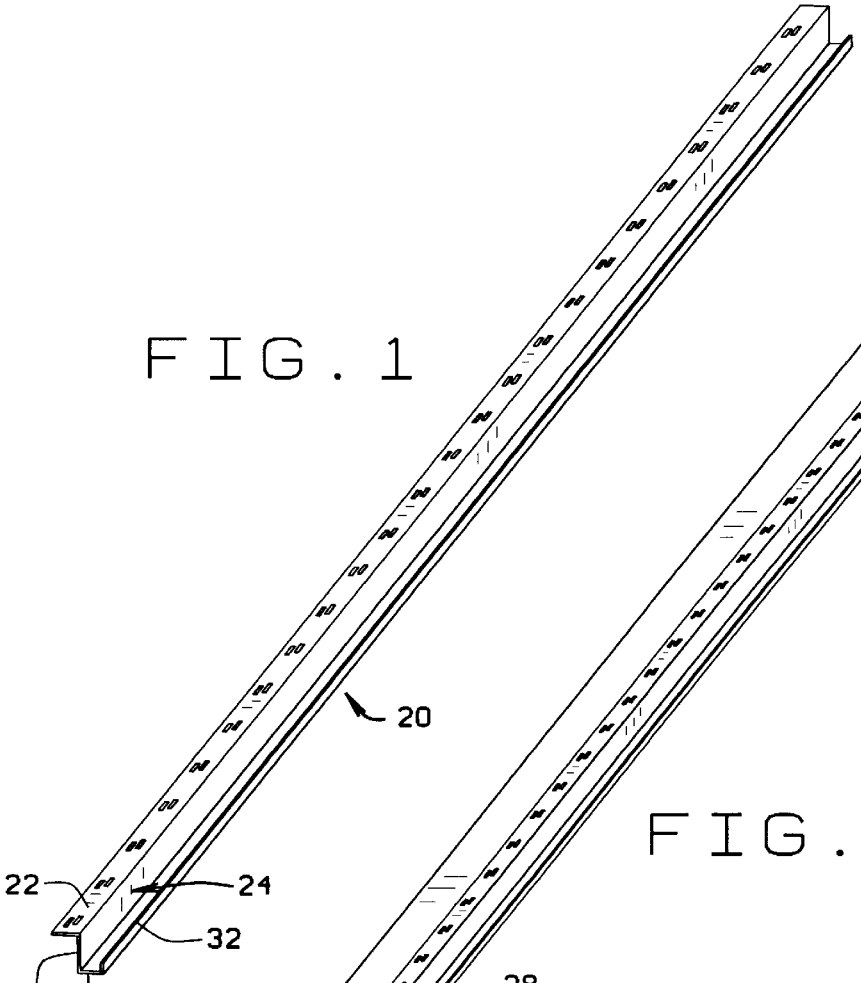
FIG. 1
FIG. 3
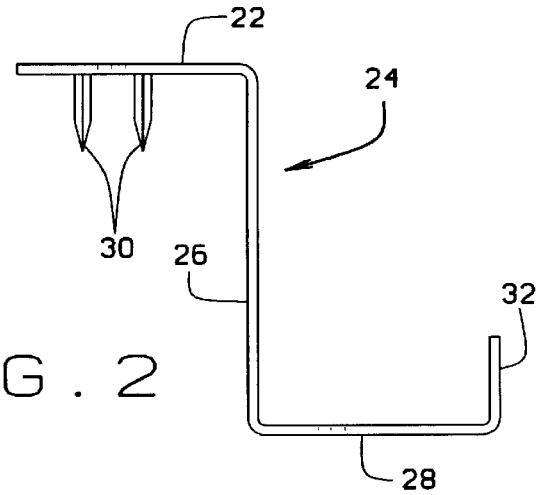
FIG. 2

IN-PLANE BRACE FOR WEB MEMBERS IN TRUSSES AND TRUSS WITH BRACED WEB MEMBERS

FIELD OF THE INVENTION

This invention relates to a brace for the web members in trusses to reduce bowing and flexing of the web members out of the plane of the truss, and to a truss with braced web members.

BACKGROUND OF THE INVENTION

Prefabricated trusses are widely used in modern construction, and provide fast construction and strength and reliability in service. These trusses typically comprise upper and lower chord members forming the perimeter of the truss, and a plurality of web members between the chord members. Some of these web members are under tension, and some of these web members are under compression. The chord members and web members are usually made of wood, and joined with nailing plates, or they may be made of metal members and joined with hardware. Under certain loading conditions some of the web members that are under compressive loading in a truss may tend to bend or flex out of the plane of the truss. This bending or flexing weakens the truss, and can potentially lead to failure. Thus, it is common to brace the web members in a truss by tying the web members of adjacent trusses together. Ultimately the web members must be tied to a rigid structure, such as an end wall, or the effect of tying the web members together will simply be causing the tied web members to fail in unison. It is tedious and time consuming to properly tie the web members, and the failure to properly tie web members is a common cause of truss failure. Sometimes it is not possible to tie the web members together, for example where adjacent trusses have different configurations. In these cases the web members may be individually supported by securing stiffeners to the web members. On a wooden web member, for example, a section of lumber whose wider dimension is perpendicular to the wider dimension of the web member can be nailed to the web member. Because these stiffeners project out of the plane of the truss, they must be individually installed at the work site, otherwise the stiffeners would interfere with the handling of the trusses in which the stiffeners are incorporated. It is tedious and time consuming to install these stiffeners at the job site, and thus it is very expensive.

SUMMARY OF THE INVENTION

The present invention relates to a brace that can be attached to web members in a generally planar truss to resist flexing of the web members out of the plane of the truss. The web members typically have a generally rectangular cross section with first and second faces, generally parallel to the plane of the truss, and two sides extending between the first and second faces. When the brace is attached to a web member, the web member better resists bending and flexing out of the plane, and thus a truss made with web members provided with the brace maintains its designed strength without the need for labor intensive, time consuming cross bracing or stiffening at the construction site.

Generally the brace of the present invention is adapted to be secured on one of the faces of the web member, with the body of the brace positioned substantially between the faces of the web member. A first embodiment of a brace constructed according to the principles of this invention comprises an elongate metal member comprising a flange adapted to overlie a portion of one of the faces of the web member, adjacent one side, and a body having a generally "L" shaped cross section. The body comprises a first section extending generally perpendicularly from the flange forming the back of the "L" and a second section extending generally perpendicularly from the first section, oppositely from the flange, forming the bottom of the "L". A lip preferably extends generally perpendicularly from the second section.

The flange, which is adapted to overlie the one of the faces of the web member, preferably has teeth integrally formed therein for embedding in the face of the web member and attaching the brace to the web member. This allows the brace to be conveniently installed on web members in the truss at the same time that the nailing plates are pressed or rolled into the web members to form the truss. This eliminates additional fabrication steps. Except for the flange that overlies a portion of the face of the web member, the brace remains substantially in the plane of the web member so that the brace does not interfere with the transporting, storing, and handling of the trusses.

A second embodiment of a brace constructed according to the principles of this invention comprises a flange adapted to overlie a portion of one of the faces of the web member, adjacent one side, and a body having a generally "C" shaped cross section. The body comprises a first section extending from the flange in the same plane as the flange and a second section folded back on the first section forming the top of the "C". A third section extends generally perpendicularly from the second section forming the back of the "C". A fourth section extends generally perpendicularly to the third section forming the bottom of the "C". In one alternate construction of this second embodiment, the brace includes a lip extending perpendicularly from the fourth section. In a second alternate construction of this second embodiment, the brace includes a fifth section folded back on the fourth section.

A third embodiment of a brace constructed according to the principles of this invention comprises a flange adapted to overlie a portion of one of the faces of the web member, adjacent one side, and a body having a generally "O" shaped cross section. The body comprises a first section extending perpendicularly from the flange forming one side of the "O", a second section extending perpendicularly from the first section forming the bottom of the "O", a third section extending perpendicularly to the second section forming the other side of the "O", and a fourth section extending perpendicularly to the third section forming the top of the "O". A portion of the fourth section overlies at least a portion of the flange.

A fourth embodiment of a brace constructed according to the principles of this invention comprises a flange adapted to overlie a face of the web member. First and second sections extended perpendicularly from the edges of the flange for overlying the sides of the web member. A third section extends perpendicularly from the first section away from the flange, and a fourth section extends perpendicularly from the second section away from the flange. There is preferably a lip extending perpendicularly from the third section, and a lip extending perpendicularly from the fourth section.

The braces of this invention are of simple and inexpensive construction, and are easily included in trusses in the normal fabrication process. The braces help the web members of the truss that are subject to compressive loading to resist bending and buckling, yet the braces do not interfere with the normal handling or use of the trusses on which they are installed. These and other features and advantages will be in part apparent, and in part pointed out hereinafter.

BRIEF DESCRIPTION OF THE DRAWINGS

FIG. 1 is a perspective view of a first embodiment of a brace constructed according to the principles of this invention;

FIG. 2 is an end view of a brace constructed according to the principles of this invention;

FIG. 3 is a perspective view of a brace constructed according to the principles of this invention, shown as it would be installed on a web member;

Corresponding reference numerals indicate corresponding parts throughout the several views of the drawings.

DETAILED DESCRIPTION OF THE PREFERRED EMBODIMENT

Figure 4:
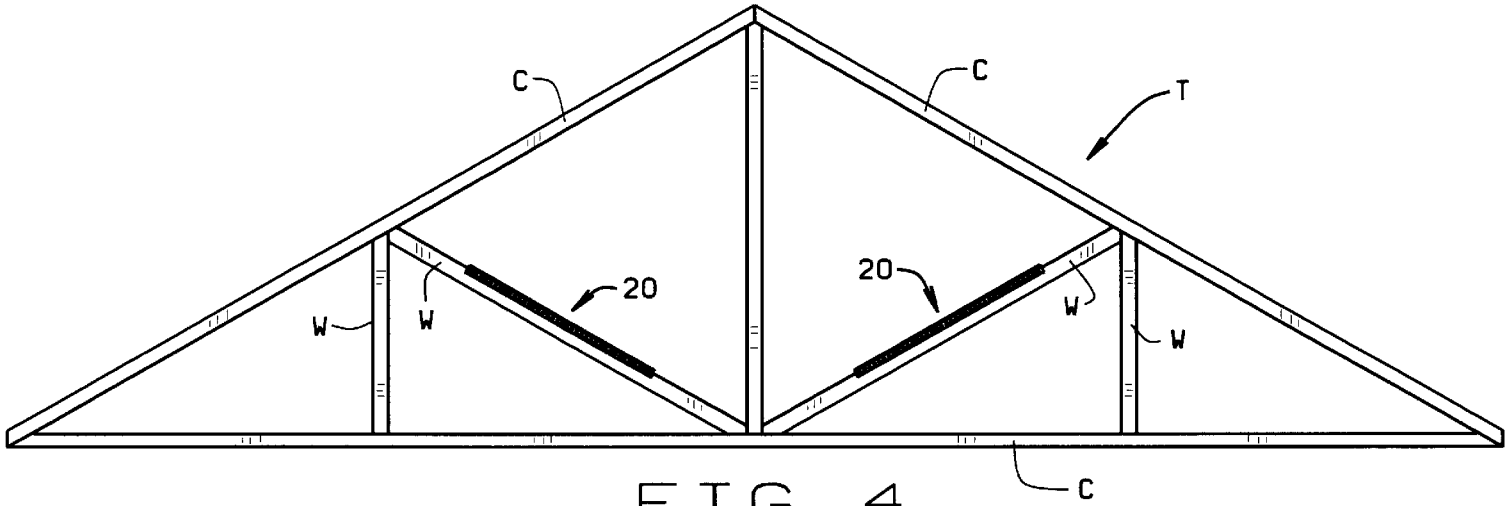
FIG. 4 is an elevation view of a truss incorporating braces constructed according to the principles of this invention.

A first embodiment of a brace constructed according to the principles of this invention is indicated generally as 20 in FIGS. 1–4. The brace 20 is adapted to be mounted onto a web member in a truss to help the web member resist bending under compressive loading. The brace 20 is preferably an elongate metal member. The brace 20 comprises a flange 22 adapted to overlie a portion of one of the faces of the web member, adjacent one side, and a body 24 having a generally "L" shaped cross-section. The body 24 has a generally "L" shaped cross-section. The body 24 comprises a first section 26 extending generally perpendicularly from the flange 22 forming the back of the "L", and a second section 28 extending generally perpendicularly from the first section, oppositely from the flange, forming the bottom of the "L".

Where the brace 20 is used on wooden web members, there are preferably a plurality of teeth 30 formed integrally in the flange 22. The teeth 30 are preferably formed in staggered pairs to facilitate their engagement with the face of a wooden web member, as described below. Where the brace 20 is used on metal web members, there may be mounting holes on the flange for securing the brace 20 on the metal web member with self-tapping screws. There is preferably a lip 32 on the free end of the second section 28, extending generally perpendicularly to the second section.

In this first preferred embodiment, the brace 20 is particularly adapted for 2× lumber, i.e., lumber having a nominal 2 inch dimension, such as 2×4, which are commonly used in prefabricated trusses. The flange 22 is preferably 1 inch wide. The first section 28 is preferably 1.5 inches wide, so that it corresponds to the thickness of a typical web member made from conventional 2× lumber. The second section 28 is preferably 1 inch wide. The lip 34 may be 0.375 inches wide.

The web members used in trusses usually have a rectangular cross-section, with relatively longer first and second faces 36 and 38 that are oriented generally parallel to the plane of the truss, and relatively shorter opposing sides 40 and 42 extending between the first and second faces. The brace 20 is adapted to be attached to one of the faces 36 or 38 of the web member, (e.g., face 36 in FIG. 3), adjacent one of the sides 40 or 42 so that the flange 22 overlies a portion of one of the faces of the web member, the first section 26 overlies a portion of the adjacent side (e.g., side 42 in FIG. 3) of the web member, and the second section 28 projects outwardly from the web member, generally parallel to, but between the faces 36 and 38 of the web member.

The brace 20 is secured to a wooden web member with integrally formed teeth 30 which can be embedded into the face of the web member with a press or roller. This can be conveniently done in the same pressing or rolling operation used to embed the nailing plates that hold the wooden chord members and web members forming the truss together. The braces 20 can be simply laid out with the wooden webs and nailing plates, eliminating the effort and expense of a separate attachment step.

The brace 20 remains substantially in the same plane as the web member W (and the truss T in which the web member W is incorporated), so that the braces do not interfere with the transporting, storage, or handling of the trusses in which they are incorporated. However when trusses incorporating the braces are used, lateral bracing or stiffeners are no longer needed to prevent bending or flexing of the web members in the truss. Thus installation is much faster and less expensive.

A truss T incorporating braces 20 is shown in FIG. 4, as being made from a plurality of chord members C and web members W. The web members W on which the braces 20 have been installed have greater resistance to compressive forces tending to flex or bow these web members out of the plane of the truss T. Thus, the truss is stronger, and more resistant to loading, without an increase in the quantity of wood used, and without the need to cross brace the web members to adjacent trusses.

Figure 5:
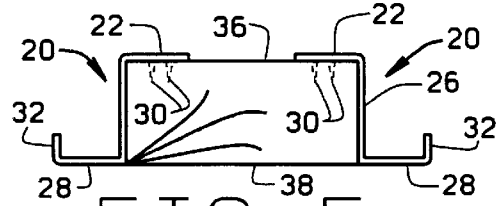
FIG. 5 is an end view of a web member on which two braces of the first embodiment have been installed.

In certain applications is may be desirable to install two braces 20 on a web member, as shown in FIG. 5. The use of two braces 20 increases the resistance of the web member W on which they are installed to bending and flexing out of the plane of the truss.

Figure 7:
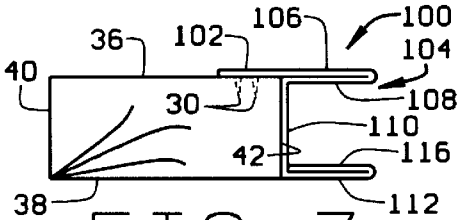
FIG. 7 is an end view of an alternate construction of the second embodiment of a brace constructed according to the principles of this invention, shown as it would be installed on a web member.
Figure 6:
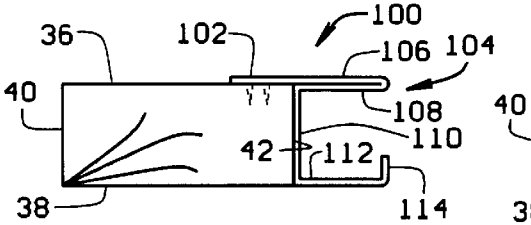
FIG. 6 is an end view of a second embodiment of a brace constructed according to the principles of this invention, shown as it would be installed on a web member.

A second embodiment of a brace constructed according to the principles of this invention is indicated generally as 100 in FIGS. 6 and 7. The brace 100, like brace 20, is adapted for mounting on a web member in a generally planar truss, and particularly on a web member having a generally rectangular cross section with first and second faces generally parallel to the plane of the truss, and sides extending between the faces, defining the thickness of the web. The brace 100 helps the web member to resist bending of the web member out of the plane of the truss. The brace 100 comprises a flange 102 adapted to overlie a portion of one of the faces of the web member, adjacent one side, and a body 104 having a generally "C" shaped cross-section. The body 104 comprises a first section 106 extending from the flange 102 generally in the same plane, and a second section 108 folded back on the first section forming the top of the "C". A third section 110 extends generally perpendicularly to the second section 108 forming the back of the "C". A fourth section 112 extends generally perpendicularly to the third section 110, forming the bottom of the "C". In a first alternate construction shown in FIG. 6, the body includes a lip 114 extending perpendicularly from the fourth section 112. In a second alternate construction shown in FIG. 7, the body 104 includes fifth section 116 folded back on the fourth section 112.

The flange 102, which is adapted to overlie one of the faces of the web member, preferably has teeth 30 integrally formed therein for embedding in the face of the web member and attaching the brace to the web member. This allows the brace to be conveniently installed on web members in the truss at the same time that the nailing plates are pressed or rolled into the web members to form the truss. Where the brace 100 is used on metal web members, there may be mounting holes on the flange for securing the brace 100 on the metal web member with self-tapping screws.

Figure 8:
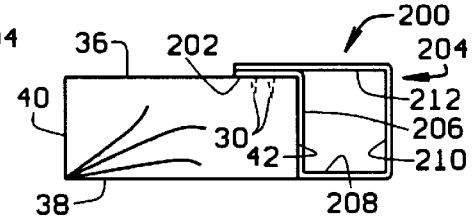
FIG. 8 is an end view of a third embodiment of a brace constructed according to the principles of this invention, shown as it would be installed on a web member.

A third embodiment of a brace constructed according to the principles of this invention is indicated generally as 200 in FIG. 8. The brace 200, like braces 20 and 100, is adapted for mounting on a web member in a generally planar truss, and particularly on a web member having a generally rectangular cross section with first and second faces generally parallel to the plane of the truss, and sides extending between the faces, defining the thickness of the web. The brace 200 helps the web member to resist bending of the web member out of the plane of the truss. The brace 200 comprises a flange 202 adapted to overlie a portion of one of the faces of the web member, adjacent one side, and a body 204 having a generally "O" shaped cross-section. The body 204 comprises a first section 206 extending perpendicularly from the flange 202 forming one side of the "O", a second section 208 extending perpendicularly from the first section, forming the bottom of the "O", a third section 210 extending perpendicularly to the second section forming the other side of the "O", and a fourth section 212 extending perpendicular to the third section forming the top of the "O", a portion of the fourth section overlying at least a portion of the flange 202.

The flange 202, which is adapted to overlie the one of the faces of the web member, preferably has teeth 30 integrally formed therein for embedding in the face of the web member and attaching the brace to the web member. This allows the brace to be conveniently installed on web members in the truss at the same time that the nailing plates are pressed or rolled into the web members to form the truss. Where the brace 200 is used on metal web members, there may be mounting holes on the flange for securing the brace 200 on the metal web member with self-tapping screws.

Figure 9:
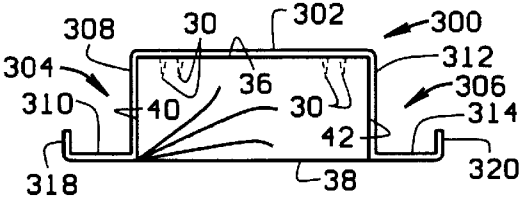
FIG. 9 is a end view of a fourth embodiment of a brace constructed according to the principles of this invention, shown as it would be installed on a web member.

A fourth embodiment of a brace constructed according to the principles of this invention is indicated generally as 300 in FIG. 9. The brace 300, like braces 20, 100, and 200, is adapted for mounting on a web member in a generally planar truss, and particularly on a web member having a generally rectangular cross section with first and second faces generally parallel to the plane of the truss, and sides extending between the faces, defining the thickness of the web. The brace 300 helps the web member to resist bending of the web member out of the plane of the truss. The brace 300 comprises a flange 302 adapted to overlie a face of the web member bodies 304 and 306 on either side of the flange. The body 304 comprises a first section 308 extending perpendicularly from one edge of the flange 302 overlying the side of the web member, and a second section 310 extending perpendicularly from the first section, away from the flange 302. The body 306 comprises a third section 312 extending perpendicularly from the opposite edge of the flange 302 overlying the opposite side of the web member, and fourth section 314 extending perpendicularly from the third section, away from the flange. There is preferably a lip 318 extending perpendicularly from the second section 310, and a lip 320 extending perpendicularly from the fourth section 314.

The flange 302, which is adapted to overlie the one of the faces of the web member, preferably has teeth 30 integrally formed therein for embedding in the face of the web member and attaching the brace to the web member. This allows the brace to be conveniently installed on web members in the truss at the same time that the nailing plates are pressed or rolled into the web members to form the truss. Where the brace 300 is used on metal web members, there may be mounting holes on the flange for securing the brace 300 on the metal web member with self-tapping screws.

OPERATION

In operation, the web members C that will comprise a truss T are arranged in a generally planar configuration. Nailing plates are arranged over the junctures of adjacent web members to overlap the adjacent web members. Braces 20, 100, 200, or 300 are arranged over the web members on which they are to be secured, with the first flange overlying a portion of the face of the chord member. The nailing plates and the braces can be simultaneously pressed into the wooden web members with a press or roller to form the completed truss in one pressing operation. In trusses with metal web members, the joining hardware and the braces can be installed on the chord members and web members at the same time.

The completed truss T has braces 20 (or 100, 200 or 300) on at least some of the web members C. The braces help the web members on which they are mounted resist bending or flexing out of the plane of the truss. This helps the truss maintain its designed properties. The body 24 of brace 20, the body 104 of brace 100, the body 204 of brace 200, and the bodies 304 and 306 of brace 300 increase the moment of inertia of the web member to which the braces are attached, so that it resists flexing, reducing or eliminating the need to tie the web members to the web members of adjacent trusses. However, the braces lie substantially within the thickness of the web members, so that the do not interfere with the transportation, storage, or handling of the truss T.

What is claimed is:

1. A truss comprising:

a plurality of chord members and web members arranged into a generally planar configuration, wherein each of the web members have a generally rectangular cross section comprising first and second faces, generally parallel to the plane of the truss, and first and second sides between the faces, the truss further comprising at least one elongate metal brace, each brace mounted on one of the web members for resisting flexing out of the plane of the truss, the brace comprising a flange overlying and contacting one of the faces of the web member, and at least one body extending from the flange and located adjacent to, and substantially within the thickness of, the web member, each body comprising a first section extending generally perpendicularly to the flange overlying one of the first and second sides of the web member, a second section, extending generally perpendicularly to the first section away from the flange, and a lip section extending generally perpendicularly from the second section toward the flange.

2. The truss according to claim 1 wherein the body has a generally "L" shaped cross section.

3. The truss according to claim 2 wherein the second section extends parallel to and between the first and second faces of the web member.

4. The truss according to claim 2 further comprising teeth integrally formed on the flange for securing the brace to the web member.

5. A truss comprising:

a plurality of chord members and web members arranged into a generally planar configuration, wherein each of the web members have a generally rectangular cross section comprising first and second faces, generally parallel to the plane of the truss, and first and second sides between the faces, the truss further comprising at least one elongate metal brace, each brace mounted on one of the web members for resisting flexing out of the plane of the truss, the brace comprising a flange overlying and contacting one of the faces of the web member, and at least one body extending from the flange and located adjacent to, and substantially within the thickness of, the web member, each body comprising a generally "C" shaped cross section, with a first section extending generally in the same plane as the flange and a second section folded back on the first section forming the top of the "C"; a third section forming the back of the "C"; and a fourth section extending generally perpendicularly to the third section, forming the bottom of the "C".

6. The truss according to claim 5 wherein the body further comprises a lip extending generally perpendicularly from the fourth section.

7. The truss according to claim 5 wherein the body further comprise a fifth section folded back on the fourth section.

8. A truss comprising:

a plurality of chord members and web members arranged into a generally planar configuration, wherein each of the web members have a generally rectangular cross section comprising first and second faces, generally parallel to the plane of the truss, and first and second sides between the faces, the truss further comprising at least one elongate metal brace, each brace mounted on one of the web members for resisting flexing out of the plane of the truss, the brace comprising a flange overlying and contacting one of the faces of the web member, and at least one body extending from the flange and located adjacent to, and substantially within the thickness of, the web member, each body comprising a generally "O" shaped cross section comprising a first section extending perpendicularly from the flange forming one side of the "O"; a second section extending perpendicularly from the first section, forming the bottom of the "O"; a third section extending perpendicularly to the second section forming the other side of the "O"; and a fourth section extending perpendicular to the third section forming the top of the "O", a portion of the fourth section overlying at least a portion of the flange.

9. The truss according to claim 1 wherein the brace comprises two bodies, a first body on one side of the flange, and a second body on the other side of the flange, the first section of the first body overlying the first side of the web member and the first section of the second body overlying the second side of the web member.

10. The truss according to claim 9 wherein the second and fourth sections are configured to extend parallel to and between the first and second faces of the web member.

11. A web member in a truss comprising a plurality of chord members and web members arranged in a generally planar configuration, each of the web members having a generally rectangular cross section and comprising first and second faces, generally parallel to the plane of the truss, and first and second sides between the faces, the web member comprising:

an elongate metal brace mounted on the web member and lying substantially within the plane of the truss for resisting flexing out of the plane of the truss, the brace comprising a flange overlying and contacting one of the faces of the web member, and at least one body extending from the flange, adjacent to, and located substantially within the thickness of, the web member, each body comprising a first section extending generally perpendicularly to the flange overlying one of the first and second sides of the web member, a second section, extending generally perpendicularly to the first section away from the flange, and a lip section extending generally perpendicularly from the second section toward the flange.

12. The web member according to claim 11 wherein the body has a generally "L" shaped cross section.

13. The web member according to claim 12 wherein the second section is configured to extend parallel to and between the first and second faces of the web member.

14. The web member according to claim 11 comprising two bodies, a first body on one side of the flange, and a second body on the other side of the flange, the first section of the first body overlying the first side of the web member and the first section of the second body overlying the second side of the web member.

15. The web member according to claim 14 wherein the second and fourth sections are configured to extend parallel to and between the first and second faces of the web member.

16. The web member according to claim 11 further comprising teeth integrally formed on the flange for securing the brace to the wooden web member.

17. A web member in a truss comprising a plurality of chord members and web members arranged in a generally planar configuration, each of the web members having a generally rectangular cross section and comprising first and second faces, generally parallel to the plane of the truss, and first and second sides between the faces, the web member comprising:

an elongate metal brace mounted on the web member and lying substantially within the plane of the truss for resisting flexing out of the plane of the truss, the brace comprising a flange overlying and contacting one of the faces of the web member, and at least one body extending from the flange, adjacent to, and located substantially within the thickness of, the web member, each body comprising a generally "C" shaped cross section, with a first section extending generally in the same plane as the flange and a second section folded back on the first section forming the top of the "C"; a third section forming the back of the "C"; a fourth section extending generally perpendicularly to the third section, forming the bottom of the "C".

18. The web member according to claim 17 wherein the body further comprises a lip extending generally perpendicularly from the fourth section.

19. The web member according to claim 17 wherein the body further comprises a fifth section folded back on the fourth section.

20. A web member in a truss comprising a plurality of chord members and web members arranged in a generally planar configuration, each of the web members having a generally rectangular cross section and comprising first and second faces, generally parallel to the plane of the truss, and first and second sides between the faces, the web member comprising:

an elongate metal brace mounted on the web member and lying substantially within the plane of the truss for resisting flexing out of the plane of the truss, the brace comprising a flange overlying and contacting one of the faces of the web member, and at least one body extending from the flange, adjacent to, and located substantially within the thickness of, the web member, each body comprising a generally "O" shaped cross section comprising a first section extending perpendicularly from the flange forming one side of the "O"; a second section extending perpendicularly from the first section, forming the bottom of the "O"; a third section extending perpendicularly to the second section forming the other side of the "O"; and a fourth section extending perpendicular to the third section forming the top of the "O", a portion of the fourth section overlying at least a portion of the flange.

21. A brace for mounting on a web member in a generally planar truss to resist flexing of the web member out of the plane of the truss, the web members having a generally rectangular cross section with first and second faces generally parallel to the plane of the truss, and first and second sides between the faces, the brace comprising an elongate metal member having a flange configured to overlie a face of the web member, and at least one body extending from the flange and configured to fit within the thickness of the web member, the flange having teeth integrally formed therein for embedding in a face of the web member to secure the brace to the web member, each body comprising a first section extending generally perpendicularly to the flange overlying one of the first and second sides of the web member, a second section, extending generally perpendicularly to the first section away from the flange, and a lip section extending generally perpendicularly from the second section toward the flange.

22. The brace according to claim 21 wherein the body has a generally "L" shaped cross section.

23. The brace according to claim 22 wherein the second section is configured to extend parallel to and between the first and second faces of the web member.

24. The brace according to claim 21 comprising two bodies, a first body on one side of the flange, and a second body on the other side of the flange, the first section of the first body configured to overlie the first side of the web member and the first section of the second body configured to overlie the second side of the web member.

25. The brace according to claim 24 wherein the second and fourth sections are configured to extend parallel to and between the first and second faces of the web member.

26. A brace for mounting on a web member in a generally planar truss to resist flexing of the web member out of the plane of the truss, the web members having a generally rectangular cross section with first and second faces generally parallel to the plane of the truss, and first and second sides between the faces, the brace comprising an elongate metal member having a flange configured to overlie a face of the web member, and at least one body extending from the flange and configured to fit within the thickness of the web member, the flange having teeth integrally formed therein for embedding in a face of the web member to secure the brace to the web member, each body comprising a generally "C" shaped cross section, with a first section extending generally in the same plane as the flange and a second section folded back on the first section forming the top of the "C"; a third section forming the back of the "C"; and a fourth section extending generally perpendicularly to the third section, forming the bottom of the "C".

27. The brace according to claim 26 wherein the body further comprises a lip extending generally perpendicularly from the fourth section.

28. The brace according to claim 26 wherein the body further comprise a fifth section folded back on the fourth section.

29. A brace for mounting on a web member in a generally planar truss to resist flexing of the web member out of the plane of the truss, the web members having a generally rectangular cross section with first and second faces generally parallel to the plane of the truss, and first and second sides between the faces, the brace comprising an elongate metal member having a flange configured to overlie a face of the web member, and at least one body extending from the flange and configured to fit within the thickness of the web member, the flange having teeth integrally formed therein for embedding in a face of the web member to secure the brace to the web member, each body comprising a generally "O" shaped cross section comprising a first section extending perpendicularly from the flange forming one side of the "O"; a second section extending perpendicularly from the first section, forming the bottom of the "O"; third section extending perpendicularly to the second section forming the other side of the "O"; and a fourth section extending perpendicular to the third section forming the top of the "O", a portion of the fourth section overlying at least a portion of the flange.

30. A method of assembling a truss comprising the steps of:

arranging a plurality of chord members and web members in a generally planar configuration;

arranging a plurality of nailing plates at the junctures between adjacent web members, adjacent chord members, and adjacent chord and web members, to overlap the adjacent members;

arranging at least one brace, comprising an elongate metal member having a flange having a plurality of teeth formed integrally in the flange, and a body extending from the flange, so that the flange overlies a face of the web member with the body positioned adjacent to, and within the thickness of, the web member, the body comprising a first section extending generally perpendicularly to the flange overlying a side of the web member, a second section, extending generally perpendicularly to the first section away from the flange, and a lip section extending generally perpendicularly from the second section toward the flange;

simultaneously pressing the nailing plates and the at least one brace into the web and chord members to form the truss.

* * * * *